US010224130B2

(12) United States Patent
Tanaka et al.

(10) Patent No.: US 10,224,130 B2
(45) Date of Patent: Mar. 5, 2019

(54) CABLE

(71) Applicant: SUMITOMO ELECTRIC INDUSTRIES, LTD., Osaka-shi, Osaka (JP)

(72) Inventors: Shigeyuki Tanaka, Osaka (JP); Shinya Nishikawa, Osaka (JP); Yuhei Mayama, Kanuma (JP); Hiroyuki Okawa, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/740,469

(22) PCT Filed: Feb. 7, 2017

(86) PCT No.: PCT/JP2017/004314

§ 371 (c)(1),
(2) Date: Dec. 28, 2017

(87) PCT Pub. No.: WO2017/191698

PCT Pub. Date: Nov. 9, 2017

(65) Prior Publication Data

US 2018/0182511 A1 Jun. 28, 2018

(30) Foreign Application Priority Data

May 2, 2016 (JP) ..... 2016-092373

(51) Int. Cl.
*H01B 7/00* (2006.01)
*H01B 7/18* (2006.01)
(Continued)

(52) U.S. Cl.
CPC ..... *H01B 7/1875* (2013.01); *H01B 3/307* (2013.01); *H01B 3/443* (2013.01); *H01B 7/0208* (2013.01); *H01B 7/187* (2013.01)

(58) Field of Classification Search
CPC ..... H01B 7/0208
(Continued)

(56) References Cited

U.S. PATENT DOCUMENTS 5,238,767 A * 8/1993 Horiie ..... G03G 9/08704 430/108.11

FOREIGN PATENT DOCUMENTS

JP H06-212073 A 8/1994
JP 2007-5137 A 1/2007
(Continued)

*Primary Examiner* — Chau N Nguyen
(74) *Attorney, Agent, or Firm* — Drinker Biddle & Reath LLP

(57) ABSTRACT

A cable includes at least one core that has a conductor and an insulating coating layer that covers the conductor; and a sheath layer that covers the at least one core. The sheath layer includes an inner sheath layer and an outer sheath layer that covers the inner sheath layer. The inner sheath layer contains a silane-crosslinked very low density polyethylene. A main component of the outer sheath layer is polyurethane; a content of the very low density polyethylene per 100 parts by mass of a resin component in the inner sheath layer is 20 parts by mass or more and 100 parts by mass or less. A content of silicon atoms constituting silane crosslinks in the very low density polyethylene is 0.05 mass % or more and 1 mass % or less.

4 Claims, 1 Drawing Sheet

(51) Int. Cl.
*H01B 3/30* (2006.01)
*H01B 3/44* (2006.01)
*H01B 7/02* (2006.01)

(58) Field of Classification Search
USPC ..... 174/120 R
See application file for complete search history.

(56) References Cited

FOREIGN PATENT DOCUMENTS

| | | | |
|---|---|---|---|
| JP | 2016-50272 A | | 4/2016 |
| WO | WO 2009-008537 | * | 1/2009 |

* cited by examiner

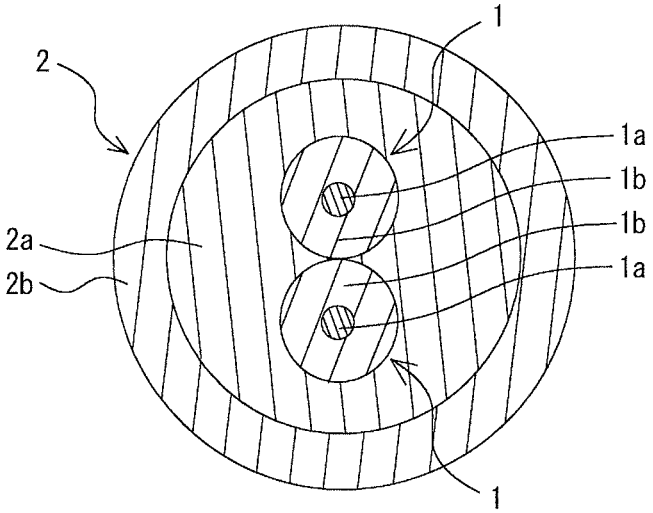
1
2
1a
1b
1b
2a
1a
2b
1

CABLE

TECHNICAL FIELD

The present invention relates to a cable. The present invention claims priority to Japanese Patent Application No. 2016-092373 filed May 2, 2016, and the entire contents of the Japanese application are hereby incorporated by reference.

BACKGROUND ART

A cable constituted by a bundle of electric wires each formed of a conductor and an insulating coating layer of polyethylene, polyvinyl chloride, or the like disposed around the conductor, and a sheath layer covering the outer periphery of the bundle has been used as a cable, such as an electric parking brake cable or a wheel speed sensor cable for automobiles. This cable is required to have heat resistance as well as toughness and flexibility because it is exposed to heat released from engines, brake discs, etc.

To meet the required heat resistance, there has been proposed a cable in which an electric wire is covered with a heat-resistant, flame-retardant polyurethane elastomer composition containing a polyurethane elastomer, a halogen flame retardant other than polybromodiphenyl ether, and a carbodiimide compound and in which a sheath layer is formed by irradiating the heat-resistant, flame-retardant polyurethane elastomer composition with an electron beam (see Japanese Unexamined Patent Application Publication No. 6-212073). This cable of related art obtains improved heat resistance through electron beam crosslinking of polyurethane in the sheath layer by electron beam irradiation.

CITATION LIST

Patent Literature

PTL 1: Japanese Unexamined Patent Application Publication No. 6-212073

SUMMARY OF INVENTION

Technical Problem

A cable according to an embodiment of the present invention includes at least one core that has a conductor and an insulating coating layer that covers the conductor; and a sheath layer that covers the at least one core. The sheath layer includes an inner sheath layer and an outer sheath layer that covers the inner sheath layer. The inner sheath layer contains a silane-crosslinked very low density polyethylene. A main component of the outer sheath layer is polyurethane. A content of the very low density polyethylene per 100 parts by mass of a resin component in the inner sheath layer is 20 parts by mass or more and 100 parts by mass or less. A content of the silicon atoms constituting silane crosslinks in the very low density polyethylene is 0.05 mass % or more and 1 mass % or less.

BRIEF DESCRIPTION OF DRAWINGS

FIG. 1 is a schematic cross-sectional view of a cable according to an embodiment of the present invention.

DESCRIPTION OF EMBODIMENTS

Solution to Problem

Electric wires used in electric parking brakes, wheel speed sensors, etc., have large diameters, and thus a cable obtained by coating a bundle of such electric wires with a sheath layer also has a large outer diameter. When the outer diameter of the cable is large, a large stress is generated when the cable is bent, and thus the strength required for the sheath layer positioned at the outer periphery of the cable is increased. In order to obtain the strength, the sheath layer tends to be thick. Since the electron beam used for electron-beam-crosslink of polyurethane in the sheath layer is applied from the outer side of the sheath layer, the output of the electron beam must be increased in order to electronically bridge the polyurethane on the inner portion of the thick sheath layer. Consequently, a high-output electron beam facility is needed to produce this cable of the related art, increasing the cost for producing this cable.

The present invention has been made under the above-described circumstances and aims to provide a cable that has toughness, flexibility, and heat resistance and that can be produced at a relatively low cost even when the sheath layer is thick.

Advantageous Effects of Invention

A cable according to the present invention has toughness, flexibility, and heat resistance and can be produced at a relatively low cost even when the sheath layer is thick. Thus, the cable according to the present invention is suitable for use in cables used in electrical wiring, such as in electric parking brakes and wheel speed sensors of automobiles, etc.

DESCRIPTION OF EMBODIMENTS

A cable according to an embodiment of the present invention includes at least one core that has a conductor and an insulating coating layer that covers the conductor; and a sheath layer that covers the at least one core, in which the sheath layer includes an inner sheath layer and an outer sheath layer that covers the inner sheath layer, the inner sheath layer contains a silane-crosslinked very low density polyethylene, a main component of the outer sheath layer is polyurethane, a content of the very low density polyethylene per 100 parts by mass of a resin component in the inner sheath layer is 20 parts by mass or more and 100 parts by mass or less, and a content of silicon atoms constituting silane crosslinks in the very low density polyethylene is 0.05 mass % or more and 1 mass % or less.

According to this cable, the inner sheath layer contains a silane-crosslinked very low density polyethylene, the content thereof is within the above-described range, and the content of the silicon atoms constituting the silane crosslinks is equal to or more than the lower limit described above. Because of these features, the very low density polyethylene has a network polymer structure formed by crosslinking reaction occurring as the silane crosslinking groups contact water. Since the heat resistance of the inner sheath layer is improved due to the silane-crosslinked polymer structure, this cable does not require electron beam crosslinking at least for the inner sheath layer. Thus, the cable either does not require an electron beam facility for production or requires only a low-output electron beam facility enough for electron beam crosslinking of the outer sheath layer. As a result, the cost for electron beam irradiation can be suppressed. Thus, the cost for producing the cable is relatively low even when the sheath layer is thick. Moreover, since the content of the silicon atoms constituting the silane crosslinks is equal to or less than the upper limit, hardening caused by the silane crosslinking groups in the inner sheath layer is suppressed, and the cable has flexibility. Moreover, the main component of the outer sheath layer of the cable is polyurethane. Polyurethane easily adheres to the very low density polyethylene, and the adhesive strength between the inner sheath layer and the outer sheath layer is easily maintained. Thus, the inner sheath layer and the outer sheath layer of this cable rarely separate from each other. Since polyurethane is used as the main component, the mechanical strength is increased and the cable has toughness.

The inner sheath layer may further contain a non-crosslinked resin. The cost for producing the cable can be further reduced when the inner sheath layer further contains a non-crosslinked resin, which is relatively inexpensive.

The non-crosslinked resin may be a copolymer of a vinyl monomer having an ester bond, and ethylene. The copolymer is relatively inexpensive and has high adhesion to polyurethane, which is the main component of the outer sheath layer. Thus, when the non-crosslinked resin is this copolymer, the cost for producing the cable can be further reduced and the inner sheath layer and the outer sheath layer are more difficult to separate from each other.

Polyurethane in the outer sheath layer is preferably an allophanate-crosslinked polyurethane. When the polyurethane in the outer sheath layer is an allophanate-crosslinked polyurethane, the strength of the outer sheath layer can be further increased and the toughness of the cable can be increased. Since there is no need to perform electron beam crosslinking on the outer sheath layer, no electron beam facility is needed and the cost for producing the cable can be further reduced.

The "very low density polyethylene" refers to a polyethylene having a specific gravity of 0.9 or less. The "main component" means a component has the highest content, and an example thereof is a component contained in an amount of 50 mass % or more and preferably 90% or more.

DETAILED DESCRIPTION OF EMBODIMENT OF THE PRESENT INVENTION

The cable according to the embodiment of the present invention will now be described in detail.

The cable illustrated in FIG. 1 includes two cores 1, and a sheath layer 2 that covers the two cores 1. The cable is suitable for use as a cable, such as an electric parking brake cable or a wheel speed sensor cable, used in electric wiring of automobiles.

<Core>

The two cores 1 are each an electric wire that transmits electrical signals and each include a conductor 1*a* and an insulating coating layer 1*b* that covers the conductor 1*a*.

The two cores 1 are arranged so that their outer peripheries contact in the length direction. Although the two cores 1 may be arranged side-by-side, they are preferably twisted. When the two cores 1 are twisted, the flexibility of the cable can be enhanced.

The conductor 1*a* of the core 1 is configured as a solid wire or a stranded wire. The strand of the conductor 1*a* may be any that can carry electric current, and examples thereof include annealed copper wires such as tinned copper wires and copper alloy wires.

The average outer diameter of the conductor 1*a* is appropriately determined on the basis of the resistance value etc., required for the core 1. The lower limit of the average outer diameter of the conductor 1*a* is preferably 0.5 mm and more preferably 0.7 mm. The upper limit of the average outer diameter of the conductor 1*a* is preferably 3 mm and more preferably 2.6 mm. When the average outer diameter of the conductor 1*a* is less than the lower limit, the resistance value of the core 1 becomes excessively high, and the electrical signals may be insufficiently transmitted. In contrast, when the average outer diameter of the conductor 1*a* exceeds the upper limit, the core 1 becomes undesirably thick, and thus the flexibility of the cable may be degraded. The "average outer diameter" of the conductor refers to a value obtained by averaging, in the length direction, the diameters of circles having the same areas as that of a cross-section of the conductor.

The main component of the insulating coating layer 1*b* of the core 1 may be any as long as insulation is maintained, and resins such as polyethylene and polyurethane can be used. The resin is preferably crosslinked through electron beam irradiation. When the resin is crosslinked, the heat resistance of the core 1 is improved.

The lower limit of the average thickness of the insulating coating layer 1*b* is preferably 0.15 mm and more preferably 0.2 mm. The upper limit of the average thickness of the insulating coating layer 1*b* is preferably 0.8 mm and more preferably 0.7 mm. When the average thickness of the insulating coating layer 1*b* is less than the lower limit, the insulating property of the core 1 becomes insufficient, and short-circuiting may occur between adjacent cores 1. In contrast, when the average thickness of the insulating coating layer 1*b* exceeds the upper limit, the core 1 becomes undesirably thick, and thus the flexibility of the cable may be degraded.

If needed, additives such as antioxidants and flame retardants may be appropriately added to the insulating coating layer 1*b*. Examples of the heat-resistant aging preventing agent include phenolic antioxidants such as tetrakis-[methylene-3-(3',5'-di-tert-butyl-4'-hydroxyphenyl)propionate] methane and octadecyl-3-(3,5-di-tert-butyl-4-hydroxyphenyl)propionate, and amine antioxidants such as 4,4'-dioctyldiphenylamine and N-phenyl-N'-1,3-dimethylbutyl-p-phenylenediamine. Examples of the flame retardant include bromine organic compounds, antimony trioxide, magnesium hydroxide, aluminum hydroxide, and calcium hydroxide.

The lower limit of the average outer diameter of the core 1 is preferably 1 mm and more preferably 1.3 mm. The upper limit of the average outer diameter of the core 1 is preferably 4 mm and more preferably 3.8 mm. When the average outer diameter of the core 1 is less than the lower limit, the average outer diameter of the conductor 1*a* or the average thickness of the insulating coating layer 1*b* becomes insufficient, and thus the conductivity of the core 1 may become insufficient or the insulating property may become insufficient. In contrast, when the average outer diameter of the core 1 exceeds the upper limit, the core 1 becomes undesirably thick, and thus the flexibility of the cable may be degraded.

<Sheath Layer>

The sheath layer 2 includes an inner sheath layer 2*a* that covers the two cores 1, and an outer sheath layer 2*b* that covers the inner sheath layer 2*a*.

(Inner Sheath Layer)

The inner sheath layer 2*a* contains a silane-crosslinked very low density polyethylene (VLDPE).

The lower limit of the content of VLDPE per 100 parts by mass of the resin component in the inner sheath layer 2*a* is 20 parts by mass, preferably 40 parts by mass, and more preferably 50 parts by mass. When the content of the VLDPE is less than the lower limit, silane crosslinking in the cable may become insufficient. The upper limit of the content of VLDPE is not particularly limited and may be 100 parts by mass. In order to contain a non-crosslinked resin described below, the upper limit is more preferably 90 parts by mass.

The lower limit of the content of the silicon atoms constituting the silane crosslinks in the VLDPE in the inner sheath layer 2*a* is 0.05 mass % and more preferably 0.1 mass %. The upper limit of the content of the silicon atoms is 1 mass % and more preferably 0.5 mass %. When the content of the silicon atoms is less than the lower limit, the heat resistance improving effect brought by silane-crosslinking in the cable may become insufficient. In contrast, when the content of the silicon atoms exceeds the upper limit, the flexibility of the cable may be degraded.

The inner sheath layer 2*a* preferably contains a non-crosslinked resin. When a non-crosslinked resin, which is relatively inexpensive, is contained in the inner sheath layer 2*a*, the cost for producing the cable can be further reduced. Examples of the non-crosslinked resin include polyethylene (PE), polypropylene (PP), polyvinyl chloride (PVC), and a copolymer of ethylene and a vinyl monomer that contains an ester bond. These non-crosslinked resins may be used alone or in combination as a mixture. Here, the "non-crosslinked resin" refers to a resin that is not crosslinked.

In particular, a copolymer of ethylene and a vinyl monomer that contains an ester bond is preferable as the non-crosslinked resin. The copolymer is relatively inexpensive and yet has high adhesion to polyurethane, which is the main component of the outer sheath layer 2*b*. Thus, when the copolymer is used as the non-crosslinked resin, not only the cost for producing the cable can be further reduced, but also the inner sheath layer 2*a* and the outer sheath layer 2*b* can be made even more difficult to separate. Examples of the copolymer include an ethylene-vinyl acetate copolymer, an ethylene-methyl acrylate copolymer, an ethylene-ethyl acrylate copolymer, an ethylene-butyl acrylate copolymer, an ethylene-methyl methacrylate copolymer, an ethylene-ethyl methacrylate copolymer, and an ethylene-butyl methacrylate copolymer.

When the inner sheath layer 2*a* contains a non-crosslinked resin, the lower limit of the content of the non-crosslinked resin per 100 parts by mass of the resin component in the inner sheath layer 2*a* is preferably 10 parts by mass and more preferably 20 parts by mass. The upper limit of the content of the non-crosslinked resin is preferably 80 parts by mass and more preferably 60 parts by mass. When the content of the non-crosslinked resin is less than the lower limit, the effect of reducing the cost for producing the cable brought by using the non-crosslinked resin may become insufficient. In contrast, when the content of the non-crosslinked resin exceeds the upper limit, the amount of the silane-crosslinked VLDPE relatively decreases, and the heat resistance improving effect brought by the silane crosslinking of the cable may become insufficient.

The average outer diameter of the inner sheath layer 2*a* is appropriately determined so that the inner sheath layer 2*a* can cover the two cores 1. The lower limit of the average outer diameter of the inner sheath layer 2*a* is preferably 3 mm and more preferably 3.4 mm. The upper limit of the average outer diameter of the inner sheath layer 2*a* is preferably 12 mm and more preferably 11 mm. When the average outer diameter of the inner sheath layer 2*a* is less than the lower limit, the heat resistance improving effect brought by the silane crosslinking in the cable may become insufficient. In contrast, when the average outer diameter of the inner sheath layer 2*a* exceeds the upper limit, the cable becomes undesirably thick, and thus the flexibility of the cable may be degraded.

The thickness of the inner sheath layer 2*a* covering the two cores 1 adjacent to each other is usually uneven. The lower limit of the average minimum thickness of the inner sheath layer 2*a* is preferably 0.3 mm and more preferably 0.45 mm. The upper limit of the average minimum thickness of the inner sheath layer 2*a* is preferably 3 mm and more preferably 2.5 mm. When the average minimum thickness of the inner sheath layer 2*a* is less than the lower limit, the heat resistance improving effect brought by silane crosslinking in the cable may become insufficient. In contrast, when the average minimum thickness of the inner sheath layer 2*a* exceeds the upper limit, the cable becomes undesirably thick, and thus the flexibility of the cable may be degraded. The "average minimum thickness" of the inner sheath layer refers to a value obtained by averaging, in the length direction, the minimum values of the distances between any points on the outer periphery of the inner sheath layer and any points on the outer periphery of the core.

A catalyst for accelerating crosslinking is preferably added to the inner sheath layer 2*a*.

Examples of the catalyst include carboxylates of metals such as tin, zinc, iron, lead, cobalt, barium, and calcium, titanate esters, organic bases, inorganic acids, and organic acids. The lower limit of the content of the catalyst per 100 parts by mass of the resin in the inner sheath layer 2*a* is preferably 0.01 parts by mass and more preferably 0.03 parts by mass. The upper limit of the content of the catalyst is preferably 0.15 parts by mass and more preferably 0.12 parts by mass. When the content of the catalyst is less than the lower limit, crosslinking of VLDPE in the inner sheath layer 2*a* may not proceed sufficiently. In contrast, when the content of the catalyst exceeds the upper limit, the amount of the silane-crosslinked VLDPE is relatively decreased, and the effect of improving the heat resistance of the cable through silane crosslinking may become insufficient.

If needed, additives such as a heat-resistant aging preventing agent and a flame retardant may be appropriately added to the inner sheath layer 2*a*. Examples of the heat-resistant aging preventing agent and the flame retardant can be the same as those for the insulating coating layer 1*b*. The content of the additives in the inner sheath layer 2*a* is determined so that the effects of the additives are exhibited while maintaining the heat-resistance improving effect brought by the silane-crosslinked VLDPE, and can be 0.1 parts by mass or more and 15 parts by mass or less per 100 parts by mass of the resin.

(Outer Sheath Layer)

The main component of the outer sheath layer 2*b* is polyurethane (PU). In particular, a thermoplastic polyurethane, which has excellent flexibility, is preferable.

The polyurethane can be an electron-beam-crosslinked polyurethane and is preferably an allophanate-crosslinked polyurethane. When the polyurethane in the outer sheath layer 2*b* is an allophanate-crosslinked polyurethane, the strength of the outer sheath layer 2*b* is further enhanced, and the toughness of the cable can be enhanced. Since there is no need to perform electron beam crosslinking on the outer sheath layer 2*b* and since there is no need to perform electron beam crosslinking on the inner sheath layer 2*a* due to the silane-crosslinked VLDPE, an electron beam facility for crosslinking the sheath layer 2 is unnecessary. Thus, the cost for producing the cable can be further reduced.

The allophanate-crosslinked polyurethane can be produced by using, for example, a compound prepared by adding, to a polyurethane base resin, a polyvalent isocyanate compound, such as diphenylmethane diisocyanate or dicyclohexane diisocyanate, or by using an outer sheath layer resin composition, such as an allophanate-crosslinkable polymer prepared by adding an isocyanate group to a polyurethane base resin. The lower limit of the content of the polyvalent isocyanate compound per 100 parts by mass of the resin component constituting the outer sheath layer 2*b* is preferably 2 parts by mass and more preferably 4 parts by mass. The upper limit of the content of the polyvalent isocyanate compound is preferably 15 parts by mass and more preferably 12 parts by mass.

The lower limit of the content of PU per 100 parts by mass of the resin component in the outer sheath layer 2*b* is preferably 50 parts by mass, more preferably 80 parts by mass, and yet more preferably 90 parts by mass. When the content of the PU is less than the lower limit, the adhesive strength between the inner sheath layer 2*a* and the outer sheath layer 2*b* may become insufficient. The upper limit of the content of the PU is not particularly limited and may be 100 parts by mass.

The lower limit of the average thickness of the outer sheath layer 2*b* is preferably 0.2 mm and more preferably 0.3 mm. The upper limit of the average thickness of the outer sheath layer 2*b* is preferably 0.7 mm and more preferably 0.6 mm. When the average thickness of the outer sheath layer 2*b* is less than the lower limit, the strength of the cable may become insufficient. When the average thickness of the outer sheath layer 2*b* exceeds the upper limit, the cable becomes undesirably thick, and thus the flexibility of the cable may be degraded. When an electron-beam-crosslinked polyurethane is used in the outer sheath layer 2*b*, a high-output electron beam facility is necessary to electron-beam-crosslink the outer sheath layer 2*b*, and the effect of reducing the cost for producing the cable may become insufficient.

If needed, additives such as a heat-resistant aging preventing agent and a flame retardant may be appropriately added to the outer sheath layer 2*b*. Examples of the heat-resistant aging preventing agent and the flame retardant can be the same as those for the insulating coating layer 1*b*.

The lower limit of the average outer diameter of the cable is preferably 3.5 mm and more preferably 4 mm. The upper limit of the average outer diameter of the cable is preferably 13 mm and more preferably 12 mm. When the average outer diameter of the cable is less than the lower limit, the thickness of the sheath layer 2 becomes insufficient, and the insulating property of the cable may become insufficient. When the average outer diameter of the cable exceeds the upper limit, the cable becomes undesirably thick, and thus the flexibility of the cable may be degraded.

The lower limit of the adhesive strength between the inner sheath layer 2*a* and the outer sheath layer 2*b* of the cable in a 90° peel test is preferably 2.5 N/cm and more preferably 3.5 N/cm. When the adhesive strength is less than the lower limit, the inner sheath layer 2*a* and the outer sheath layer 2*b* may separate from each other when the cable is in service. The upper limit of the adhesive strength is not particularly limited but is usually about 15 N/cm. Here, the "adhesive strength in a 90° peel test" refers to a value measured according to the 90° peel test described in JIS-K-6854 (1999).

The upper limit of the elastic modulus of the cable at 25° C. is preferably 30 MPa and more preferably 25 MPa. When the elastic modulus exceeds the upper limit, the flexibility of the cable may become insufficient. The lower limit of the elastic modulus is not particularly limited and can be, for example, 5 MPa from the viewpoint of heat resistance described below. Here, the "elastic modulus" refers to a value of storage elastic modulus measured by a dynamic viscoelastic measurement method.

The lower limit of the elastic modulus of the cable at 150° C. is preferably 0.1 MPa and more preferably 0.2 MPa. When the elastic modulus is less than the lower limit, the heat resistance of the cable may become insufficient. The upper limit of the elastic modulus is not particularly limited, but can be, for example, 0.8 MPa from the viewpoint of flexibility.

<Method for Producing Cable>

The cable can be produced by, for example, a method that includes a step of preparing a resin composition for forming the sheath layer 2 and a step of extrusion-molding the resin composition.

(Resin Composition Preparation Step)

In the resin composition preparation step, an inner sheath layer resin composition for forming the inner sheath layer 2*a* and an outer sheath layer resin composition for forming the outer sheath layer 2*b* are prepared.

As the inner sheath layer resin composition, for example, a compound prepared by adding a silane compound to a VLDPE base resin or a silane-crosslinkable polymer containing A VLDPE base resin and active silane groups can be used. Additives, such as a catalyst for accelerating crosslinking reaction and a heat-resistant aging preventing agent can also be added. When a non-crosslinked resin is to be contained in the inner sheath layer 2*a*, a non-crosslinked resin is further added to the inner sheath layer resin composition. The inner sheath layer resin composition is, for example, melt-kneaded with an open roll mixer, a pressure kneader, a Bunbury mixer, a twin-screw extruder, or the like and formed into pellets, for example.

Examples of the silane compound include alkoxysilane, vinyltrimethoxysilane, and vinyltriethoxysilane.

The silane-crosslinkable polymer can be produced by, for example, a method that includes adding a silane compound to a VLDPE base resin, stirring the resulting mixture with a super mixer or the like at room temperature, and kneading the resulting mixture with a pressure kneader, a Bunbury mixer, or a twin-screw or single-screw extruder while heating the mixture to a temperature equal to or higher than the melting point of VLDPE. As a result, the silane compound is grafted to the base resin, and a silane-crosslinkable polymer is obtained.

In order to accelerate grafting of the silane compound, a radical generator may be added together with the silane compound. Examples of the radical generator include dicumyl peroxide, α,α-bis(t-butylperoxydiisopropyl)benzene, di-t-butyl peroxide, t-butylcumyl peroxide, di-benzoyl peroxide, 2,5-dimethyl-2,5-bis(t-butylperoxy)hexane, t-butylperoxy pivalate, and t-butylperoxy-2-ethylhexanoate.

The lower limit of the content of the radical generator per 100 parts by mass of the base resin is preferably 0.02 parts by mass and more preferably 0.05 parts by mass. The upper limit of the content of the radical generator is preferably 0.15 parts by mass and more preferably 0.12 parts by mass. When the content of the radical generator is less than the lower limit, grafting of the silane compound may become insufficient. When the content of the radical generator exceeds the upper limit, the workability of the inner sheath layer 2*a* may be degraded, and appearance may be deteriorated when the inner sheath layer 2*a* is molded due to occurrence of local grafting.

As the outer sheath layer resin composition, for example, a composition containing polyurethane can be used. The composition may further contain additives such as a heat-resistant aging preventing agent.

When the outer sheath layer 2*b* is to be allophanate-crosslinked, for example, a compound prepared by adding, to a polyurethane base resin, a polyvalent isocyanate compound, such as diphenylmethane diisocyanate or dicyclohexane diisocyanate, or an allophanate-crosslinkable polymer prepared by adding an isocyanate group to a polyurethane base resin can be used as the outer sheath layer resin composition. A catalyst for accelerating the crosslinking reaction may also be added. The allophanate-crosslinkable polymer can be produced by the same method for producing the silane-crosslinkable polymer by using a polyurethane base resin and a polyvalent isocyanate compound.

(Extrusion Molding Step)

In the extrusion molding step, for example, the inner sheath layer resin composition and the outer sheath layer resin composition are extruded onto the perimeter of two cores 1 twisted together so that the outer sheath layer resin composition is positioned on the outer side.

Extrusion molding can be conducted by using a known melt extruder. Extrusion may be conducted by first extruding the inner sheath layer resin composition onto the perimeter of the cores 1 and then extruding the outer sheath layer resin composition on the outer perimeter of the inner sheath layer resin composition, or may be conducted by extruding the inner sheath layer resin composition and the outer sheath layer resin composition simultaneously so that the outer sheath layer resin composition is positioned on the outer side.

A crosslinking treatment is performed on the sheath layer 2 after extrusion. The crosslinking treatment can be conducted by leaving the sheath layer 2 to stand at room temperature; however, in order to shorten the time taken for this step, water crosslinking using water, water vapor, etc., can be employed as the crosslinking treatment. The water crosslinking is conducted, for example, in a high-humidity thermostat under conditions of a temperature of 50° C. or higher and 100° C. or lower and a humidity of 85% or higher and 95% or lower for 24 hours or longer.

The sheath layer 2 may be irradiated with an electron beam to further conduct electron beam crosslinking; however, it is preferable not to conduct electron beam irradiation. The cable exhibits improved heat resistance due to the silane-crosslinked VLDPE even without conducting electron beam irradiation. Since electron beam irradiation is not conducted, the electron beam facility for crosslinking the sheath layer 2 is unnecessary, and the cost for producing the cable can be further reduced.

<Advantages>

The cable includes the inner sheath layer 2*a* that contains a silane-crosslinked very low density polyethylene, the content of the very low density polyethylene per 100 parts by mass of the resin component in the inner sheath layer 2*a* is 20 parts by mass or more and 100 parts by mass or less, and the content of the silicon atoms constituting the silane crosslinks is 0.05% by mass or more. Thus, the very low density polyethylene has a network polymer structure resulting from crosslinking reaction of silane crosslinking groups coming into contact with water. Since the heat resistance of the inner sheath layer 2*a* is improved by the silane-crosslinked polymer structure, this cable does not need electronic bridging at least for the inner sheath layer 2*a*. Thus, the cable either does not require an electron beam facility for production or requires only a low-output electron beam facility enough for electronic bridging of the outer sheath layer 2*b*. Thus, the cost required for the electron beam irradiation can be suppressed.

Thus, the cost for producing the cable is relatively low even when the thickness of the sheath layer 2 is large. Since the content of the silicon atoms constituting the silane crosslinks is 1% by mass or less, hardening of the inner sheath layer 2*a* due to the silane crosslinking groups is suppressed, and the cable exhibits flexibility. Moreover, the main component of the outer sheath layer 2*b* of the cable is polyurethane. Since the polyurethane and the very low density polyethylene readily adhere to each other and the adhesive strength between the inner sheath layer 2*a* and the outer sheath layer 2*b* is easily maintained, the inner sheath layer 2*a* and the outer sheath layer 2*b* of the cable rarely separate from each other. Moreover, since the polyurethane contained as a main component increases mechanical strength, the cable exhibits toughness.

Other Embodiments

The embodiments disclosed herein are illustrative in all aspects and should not be considered limiting. The scope of the present invention is not limited by the features of the embodiments described above but is defined by the claims. All modifications and alterations within the scope and meaning of the claims and their equivalents are intended be included within the scope.

In the embodiment described above, two cores are provided. Alternatively, the number of cores may be 1 or 3 or more.

The cable may further include another layer between the core and the sheath layer or on the outer periphery of the sheath layer. An example of the layer disposed between the core and the sheath layer is a paper tape layer that facilitates removal of the core from the cable. An example of the layer disposed on the outer periphery of the sheath layer is a shielding layer.

In the embodiment described above, the method for producing the cable by conducting the crosslinking treatment after extrusion molding is described. Alternatively, extrusion molding may be conducted after the crosslinking treatment is performed on the resin compositions.

In the embodiment described above, the inner sheath layer resin composition containing a non-crosslinked resin and subjected to melt kneading is fed to the extruder. Alternatively, the non-crosslinked resin may be mixed at the time of extrusion molding. Specifically, the inner sheath layer resin composition and the non-crosslinked resin may each be prepared as pellets, and the pellets may be injected into the extruder so that the non-crosslinked resin is mixed while being extruded.

The cable is not limited to a cable used in electric wiring of automobiles and may be used as, for example, a cable for power supply for automobiles, a cable for electronic devices required to have heat resistance, or the like.

EXAMPLES

The present invention will now be described more specifically through examples which do not limit the present invention.

[No. 1]

First, VLDPE ("ENGAGE 8100" produced by the Dow Chemical Company) having a specific gravity of 0.870 serving as a base resin and alkoxysilane ("KBM1003" produced by Shin-Etsu Silicones) serving as a silane compound were mixed so that the content of the silicon atoms (Si content) constituting the silane crosslinks in VLDPE was 0.2% by mass. To a super mixer, 100 parts by mass of this mixture, and 1 part by mass of dicumyl peroxide ("PERCUMYL D" produced by NOF CORPORATION) serving as a radical generator were fed, and the resulting mixture was stirred at room temperature by rotating the rotor at 60 rpm. Then the mixture was fed to a pressure kneader having a mixing capacity of 3 L, a rotor was rotated at 30 rpm, and the mixture was melt-kneaded at a start temperature of 100° C. and a kneading finish temperature of 200° C. so as to obtain a silane crosslinking group-containing VLDPE.

A mixture of the silane crosslinking group-containing VLDPE, a non-crosslinked EVA ("Evaflex EV360" produced by DU PONT-MITSUI POLYCHEMICALS CO., LTD.), an antioxidant (Irganox 1010 produced by BASF), and a catalyst (dioctyltin) was prepared as the inner sheath layer resin composition so as to have a composition indicated in Table 1.

An ether-based polyurethane ("ET385-50" produced by BASF) was prepared as the outer sheath layer resin composition. This polyurethane is polyurethane that does not contain allophanate crosslinking groups.

The inner sheath layer resin composition and the outer sheath layer resin composition were simultaneously extrusion-molded onto the perimeter of the two cores (conductor diameter: 2.4 mm, insulating coating layer thickness: 0.3 mm) twisted together so that the outer sheath layer resin composition was positioned on the outer side. In extrusion molding, a die was used such that the average outer diameter of the cable was 8.3 mm and the average thickness of the outer sheath layer was 0.5 mm. After extrusion molding, a crosslinking treatment was performed in a high-humidity, high-temperature chamber at a temperature of 60° C. and a humidity of 90% for 24 hours to obtain a cable No. 1.

[Nos. 2 to 4 and 8]

Cables of Nos. 2 to 4 and 8 were obtained as with No. 1 except that the inner sheath layer resin composition of No. 1 was changed to have the silane crosslinking group-containing VLDPE content and the non-crosslinked EVA content indicated in Table 1.

[No. 5]

A polyurethane containing allophanate crosslinking groups prepared by mixing 100 parts by mass of the polyurethane of No. 2 and 20 parts by mass of a polyvalent isocyanate compound-containing polyurethane (CROSSNATE EM-30 produced by Dainichiseika Color & Chemicals Mfg. Co., Ltd., a polyurethane with a polyvalent isocyanate compound content of 30% by mass or more and 40% by mass or less) was prepared as the outer sheath layer resin composition. The content of the polyvalent isocyanate compound after mixing was 5 parts by mass or more and 6.6 parts by mass or less per 100 parts by mass of the resin component constituting the outer sheath layer. A cable No. 5 was obtained as with No. 2 except that this outer sheath layer resin composition was used.

[No. 6]

VLDPE ("ENGAGE 8100" produced by the Dow Chemical Company) having a specific gravity of 0.870 serving as a base resin and alkoxysilane ("KBM1003" produced by Shin-Etsu Silicones) serving as a silane compound were mixed so that the content of the silicon atoms (Si content) constituting the silane crosslinks in VLDPE was 0.7% by mass. A cable No. 6 was obtained as with No. 2 except that this mixture was used.

[No. 7]

A mixture of a non-crosslinked EVA ("Evaflex EV360" produced by DU PONT-MITSUI POLYCHEMICALS CO., LTD.) and an antioxidant (Irganox 1010 produced by BASF) was prepared as the inner sheath layer resin composition so as to have a composition indicated in Table 1.

Extrusion molding was conducted as with No. 1 except that this inner sheath layer resin composition was used. After extrusion molding, 180 kGy electron beam was applied to perform a crosslinking treatment. As a result, a cable No. 7 was obtained.

[Nos. 9 and 10]

Cables Nos. 9 and 10 were obtained as with No. 1 except that in preparing the silane crosslinking group-containing VLDPE, VLDPE serving as the base resin and alkoxysilane serving as the silane compound were mixed so that the Si content was as indicated in Table 1.

[No. 11]

A low density polyethylene (LDPE) having a specific gravity of 0.929 ("Novatec LF280H" produced by Japan Polyethylene Corporation) serving as a base resin and alkoxysilane ("KBM1003" produced by Shin-Etsu Silicones) serving as a silane compound were mixed so that the Si content was 0.2% by mass. Melt kneading was conducted under the same conditions as those for No. 2 by using this mixture to obtain a silane crosslinking group-containing LDPE. The "low density polyethylene" refers to a polyethylene having a specific gravity of more than 0.9 but not more than 0.93.

A cable No. 11 was obtained as with No. 2 except that this silane crosslinking group-containing LDPE was used.

[No. 12]

A cable No. 12 was obtained as with No. 11 except that the inner sheath layer resin composition of No. 11 was changed to have the silane crosslinking group-containing VLDPE content and the non-crosslinked EVA content indicated in Table 1.

[No. 13]

EVA ("SUNTEC EF1531" produced by Asahi Kasei Corporation) having a specific gravity of 0.936 serving as a base resin and alkoxysilane ("KBM1003" produced by Shin-Etsu Silicones) serving as a silane compound were mixed so that the Si content was 0.2% by mass. Melt kneading was conducted under the same conditions as those of No. 2 by using this mixture. As a result, a silane crosslinking group-containing EVA was obtained.

A cable No. 13 was obtained as with No. 2 except that this silane crosslinking group-containing EVA was used.

[No. 14]

A cable No. 14 was obtained as with No. 13 except that the inner sheath layer resin composition of No. 13 was changed to have the silane crosslinking group-containing EVA content and the non-crosslinked EVA content indicated in Table 1.

[Evaluation Method]

The cables of Nos. 1 to 14 were measured to determine the adhesive strength between the inner sheath layer and the outer sheath layer and the elastic moduli at 25° C. and 150° C. The results are indicated in Table 1.

(Adhesive Strength)

The adhesive strength was measured according to a 90° peel test described in JIS-K-6854 (1999). An adhesive strength of 2.5 N/cm or more was evaluated as high adhesive strength between the inner sheath layer and the outer sheath layer.

(Elastic Modulus)

The elastic moduli at 25° C. and 150° C. were determined by measuring the storage elastic moduli at 25° C. and 150°

C. by a dynamic viscoelastic measurement method. In measurement, the measurement frequency was 10 Hz and the strain was 0.08%. A cable was determined as having excellent flexibility when the elastic modulus at 25° C. was 30 MPa or less. A cable was determined to have resistance to thermal deformation and excellent heat resistance when the elastic modulus at 150° C. was 0.1 MPa or more.

atoms constituting the silane crosslinks in the VLDPE to 0.1% by mass or more and 0.5% by mass or less.

The above-described results indicate that a cable having excellent toughness, flexibility, and heat resistance can be obtained without electron beam irradiation when a silane-crosslinked VLDPE is used in the inner sheath layer, the content of the very low density polyethylene per 100 parts

TABLE 1

| | | Si content (mass %) | No. 1 | No. 2 | No. 3 | No. 4 | No. 5 | No. 6 | No. 7 | No. 8 | No. 9 | No. 10 | No. 11 | No. 12 | No. 13 | No. 14 |
|---|---|---|---|---|---|---|---|---|---|---|---|---|---|---|---|---|
| Inner sheath layer composition (parts by mass) | Silane crosslinking group-containing VLDPE | 0.2 | 20 | 50 | 80 | 100 | 50 | — | — | 10 | — | — | — | — | — | — |
| | Silane crosslinking group-containing VLDPE | 0.7 | — | — | — | — | — | 50 | — | — | — | — | — | — | — | — |
| | Silane crosslinking group-containing VLDPE | 1.1 | — | — | — | — | — | — | — | — | 50 | — | — | — | — | — |
| | Silane crosslinking group-containing VLDPE | 0.04 | — | — | — | — | — | — | — | — | — | 50 | — | — | — | — |
| | Silane crosslinking group-containing LDPE | 0.2 | — | — | — | — | — | — | — | — | — | — | 50 | 100 | — | — |
| | Silane crosslinking group-containing EVA | 0.2 | — | — | — | — | — | — | — | — | — | — | — | — | 50 | 100 |
| | EVA | | 80 | 50 | 20 | — | 50 | 50 | 100 | 90 | 50 | 50 | 50 | — | 50 | — |
| | Antioxidant | | 1 | 1 | 1 | 1 | 1 | 1 | 1 | 1 | 1 | 1 | 1 | 1 | 1 | 1 |
| | Catalyst | | 0.1 | 0.1 | 0.1 | 0.1 | 0.1 | 0.1 | — | 0.1 | 0.1 | 0.1 | 0.1 | 0.1 | 0.1 | 0.1 |
| Outer sheath layer | Allophanate crosslinking | | None | None | None | None | Yes | None | None | None | None | None | None | None | None | None |
| Electron beam irradiation | | | — | — | — | — | — | — | 180 kGy | — | — | — | — | — | — | — |
| Evaluation results | Adhesive strength | (N/cm) | 4.9 | 5.5 | 3.8 | 3.0 | 5.6 | 5.3 | 5.3 | 5.0 | 5.1 | 4.8 | 0.5 | 0.2 | 1.8 | 1.0 |
| | Elastic modulus at 25° C. | (MPa) | 21 | 20 | 14 | 10 | 20 | 29 | 35 | 25 | 50 | 15 | 290 | 500 | 60 | 93 |
| | Elastic modulus at 150° C. | (MPa) | 0.2 | 0.3 | 0.5 | 0.6 | 0.2 | 0.6 | 1.7 | — | 1.0 | — | 0.6 | 0.9 | 0.3 | 0.6 |

In Table 1, the "-" in the rows indicating materials means that the materials are not contained. The "-" in the row indicating electron beam irradiation means that electron beam irradiation was not conducted. The "-" in the row indicating the elastic modulus at 150° C. means that the cable excessively softened at 150° C. and the elastic modulus thereof could not be measured.

Table 1 indicates that the cable Nos. 1 to 6 have high adhesive strengths and excellent flexibility and heat resistance. In particular, the cable Nos. 1 to 6 have adhesive strength and flexibility comparable to those of the cable No. 7 subjected to electron beam irradiation.

In contrast, the cable No. 8 has inferior heat resistance due to a low silane-crosslinked VLDPE content in the inner sheath layer. The cable No. 9 has inferior flexibility due to a high content of silicon atoms constituting the silane crosslinks in the inner sheath layer. The cable No. 10 has inferior heat resistance due to a low content of silicon atoms constituting the silane crosslinks in the inner sheath layer. The cables Nos. 11 to 14 have inferior adhesive strength and flexibility due to absence of the silane-crosslinked VLDPE in the inner sheath layer.

No. 2 and No. 6 between which the only difference is the content of silicon atoms constituting the silane crosslinks in the VLDPE are compared. No. 2 has heat resistance and adhesive strength comparable to those of No. 6, and has excellent flexibility. This indicates that the flexibility can be further enhanced by adjusting the content of the silicon by mass of the resin component in the inner sheath layer is adjusted to be in the range of 20 parts by mass or more and 100 parts by mass or less, and the content of silicon atoms constituting the silane crosslinks in the very low density polyethylene is adjusted to be in the range of 0.05% by mass or more and 1% by mass or less.

REFERENCE SIGNS LIST

1 core
1*a* conductor
1*b* insulating coating layer
2 sheath layer
2*a* inner sheath layer
2*b* outer sheath layer

The invention claimed is:

1. A cable comprising at least one core that has a conductor and an insulating coating layer that covers the conductor; and a sheath layer that covers the at least one core, wherein the sheath layer includes an inner sheath layer and an outer sheath layer that covers the inner sheath layer; the inner sheath layer contains a silane-crosslinked very low density polyethylene; a main component of the outer sheath layer is polyurethane; a content of the very low density polyethylene per 100 parts by mass of a resin component in the inner sheath layer is 20 parts by mass or more and 100 parts by mass or less; and a content of silicon atoms constituting silane crosslinks in the very low density polyethylene is 0.05 mass % or more and 1 mass % or less.

2. The cable according to claim 1, wherein the inner sheath layer further contains a non-crosslinked resin.

3. The cable according to claim 2, wherein the non-crosslinked resin is a copolymer of ethylene and a vinyl monomer containing an ester bond.

4. The cable according to claim 1, wherein the polyurethane in the outer sheath layer is an allophanate-crosslinked polyurethane.

* * * * *